US011589641B2

(12) United States Patent
Zampieri et al.

(10) Patent No.: US 11,589,641 B2
(45) Date of Patent: Feb. 28, 2023

(54) SKI BOOT, MORE PARTICULARLY BOOT FOR SKI MOUNTAINEERING

(71) Applicant: Tecnica Group S.p.A., Giavera del Montello (IT)

(72) Inventors: Claudio Zampieri, Giavera del Montello (IT); Giovanni Girolimetto, Giavera del Montello (IT); Alessandro Zannin, Giavera del Montello (IT)

(73) Assignee: TECNICA GROUP S.P.A., Giavera del Montello (IT)

( * ) Notice: Subject to any disclaimer, the term of this patent is extended or adjusted under 35 U.S.C. 154(b) by 0 days.

(21) Appl. No.: 17/151,280

(22) Filed: Jan. 18, 2021

(65) Prior Publication Data

US 2021/0219653 A1 Jul. 22, 2021

(30) Foreign Application Priority Data

Jan. 20, 2020 (IT) ..... 102020000000988

(51) Int. Cl.
*A43B 5/04* (2006.01)
*A43C 11/14* (2006.01)

(52) U.S. Cl.
CPC ..... *A43B 5/0474* (2013.01); *A43B 5/04* (2013.01); *A43B 5/0449* (2013.01); *A43C 11/14* (2013.01); *A43C 11/142* (2013.01); *A43C 11/1426* (2013.01); *A43C 11/1453* (2013.01)

(58) Field of Classification Search
CPC ..... A43B 5/0474; A43B 5/04; A43B 5/0449; A43C 11/14; A43C 11/1453; A43C 11/1426; A43C 11/142
USPC ..... 36/118.7, 118.1
See application file for complete search history.

(56) References Cited

U.S. PATENT DOCUMENTS 4,470,175 A * 9/1984 Chiarella ..... A43C 11/1413 24/71 SK
4,651,392 A * 3/1987 Olivieri ..... A43C 11/142 24/71 SK
4,660,302 A * 4/1987 Arieh ..... A43C 11/004 24/274 R
4,677,768 A * 7/1987 Benoit ..... A43C 11/16 36/118.1
4,711,042 A * 12/1987 Morell ..... A43C 11/16 36/105
5,265,352 A 11/1993 Chemello
5,857,271 A 1/1999 Pallatin
(Continued)

OTHER PUBLICATIONS

Italian Search Report and Written Opinion issued for Italian Patent Application No. 102020000000988 dated Oct. 6, 2020.

*Primary Examiner* — Alissa J Tompkins
*Assistant Examiner* — Dakota Marin
(74) *Attorney, Agent, or Firm* — Howson & Howson LLP

(57) ABSTRACT

A ski boot of the kind comprising a substantially rigid outer shell and a cuff articulated to the shell is provided and further includes a locking device which can be switched between a first configuration, in which the rotation of the cuff relative to the shell is allowed, and a second configuration, in which the rotation of the cuff relative to the shell is prevented. The locking device of the ski boot also includes deadlocking means which prevents the locking device from being accidentally moved from the configuration in which it is, specifically when it is in the second configuration.

8 Claims, 5 Drawing Sheets

(56) References Cited

U.S. PATENT DOCUMENTS

| | | | | |
|---|---|---|---|---|
| 6,643,955 | B2 * | 11/2003 | Pierce | A43B 5/048 36/118.4 |
| 7,963,050 | B2 * | 6/2011 | Sartor | A43C 11/16 36/118.9 |
| 9,241,532 | B2 * | 1/2016 | Haugen | A43B 5/04 |
| 9,320,314 | B2 | 4/2016 | Zampieri et al. | |
| 9,549,592 | B2 | 1/2017 | Quagliotto et al. | |
| 9,770,063 | B2 * | 9/2017 | Sartor | A43B 5/0474 |
| 10,045,582 | B2 * | 8/2018 | Grandin | A43C 11/142 |
| 10,206,459 | B2 | 2/2019 | Grandin | |
| 10,485,290 | B2 * | 11/2019 | Parisotto | A43B 5/049 |
| 10,881,164 | B2 * | 1/2021 | Zampieri | A43B 5/0447 |
| 2014/0013629 | A1 * | 1/2014 | Haugen | A43B 5/04 36/117.1 |
| 2014/0359981 | A1 * | 12/2014 | Cotterman | A43C 11/20 24/712.9 |
| 2016/0345658 | A1 | 12/2016 | Grandin et al. | |
| 2017/0105488 | A1 | 4/2017 | Grandin et al. | |

* cited by examiner

SKI BOOT, MORE PARTICULARLY BOOT FOR SKI MOUNTAINEERING

BACKGROUND

The present invention refers to a ski boot, of the kind comprising a substantially rigid outer shell and a cuff articulated to said shell. More particularly, the present invention refers to a ski boot comprising a locking device, intended to lock the shell and the cuff articulated thereto relative to each other or leave them free from each other. The present invention may be applied, particularly, though not exclusively, to the field of boots for ski mountaineering.

According to prior art, ski boots usually comprise an inner liner made of substantially soft material and an outer shell made of a substantially rigid material. Still according to prior art, the substantially rigid shell of ski boots, which is shaped to accommodate the user's foot, is associated with a cuff suitable for accommodating the ankle and the lower part of the calf of the user.

In general, said cuff is articulated to the shell at the malleolar region, so as to allow—if desired—a rotation of the cuff relative to the shell.

This possibility is particularly important in the case of boots for ski mountaineering: when the user has to walk during the ascent, it is obviously preferable that the cuff is free to rotate relative to the shell, in order to make walking more comfortable; on the other hand, when the user descends while skiing, it is preferable that the cuff is locked with respect to the shell, both for safety reasons and for obtaining satisfactory performance, ensuring that movements—even minimal ones—of the user's leg are rigidly transmitted to the ski boot, and from this to the ski.

Locking devices are known from prior art, which devices allow to switch from a first configuration in which the cuff can rotate relative to the shell (configuration suitable for walking) to a second configuration in which the rotation of the cuff relative to the shell is prevented (configuration suitable for skiing), and vice versa.

These locking devices generally include a male element connected to the cuff and a female element connected to the shell, or vice versa, at least one of said elements being arranged to be movable. In this way, the movable element can be brought to engage with the other element or to disengage from it, for example by means of a rotation or translation movement: when the male and female elements are engaged with each other, the rotation between the shell and cuff is prevented, whereas when the male and female elements are disengaged, the cuff is free to rotate relative to the shell.

Driving means are usually provided for actuating the rotation or translation movement of the movable element, for switching the ski boot from one configuration to the other one. Said driving means may comprise, for example, a lever that can be moved by the user to actuate a rotation movement of said movable element. Usually, said lever is moved by overcoming the resistance of an elastic element, such as a spring.

More particularly, when the ski boot is in the above-mentioned first configuration (with the male and female elements of the locking device disengaged from each other), the spring is in a rest condition and it is necessary to overcome the resistance of said spring to switch to the above-mentioned second configuration.

Once the ski boot is in said second configuration, the engagement between the male and female elements of the locking device keeps it stably in said configuration, and said elements must be manually disengaged from each other by the user to switch back the ski boot to the first configuration.

However, it is to be considered that during skiing the ski boot is subject to considerable stresses, and it is likely to be subjected to impacts, even of considerable entity. It is therefore possible that accidental disengagement of the male element from the female element of the locking device may occur. This is obviously undesirable, as the user would suddenly have a ski boot in which the cuff is no longer locked relative to the shell and, on the contrary, it is free to move relative to it.

Therefore, the problem arises of eliminating the risk of sudden and unwanted movements of the cuff relative to the shell when the ski boot is used while skiing (i.e., during the descent phase).

The object of the present invention is therefore to overcome the drawbacks of prior art by providing a ski boot provided with an improved locking device capable of effectively avoiding accidental disengagement of the male element from the female element of said locking device. This and other objects are achieved by the ski boot as claimed in the appended claims.

SUMMARY

The ski boot according to the invention comprises, in a per se known manner, an outer shell made of a substantially rigid material and a cuff articulated to the rigid outer shell. The ski boot according to the invention also comprises a locking device to selectively allow or prevent the movement of said cuff relative to said shell.

Said locking device comprises a first engaging element integral with or connected to the shell and a second engaging element integral with or connected to the cuff, said first and second engaging elements being configured to cooperate with each other for locking said shell and said cuff relative to each other.

Said locking device comprises a driving element which can switch from a first position, in which said first and said second engaging elements are in a first configuration in which they are disengaged from each other, to a second position, in which said first and said second engaging elements are in a second configuration in which they are engaged with each other, and vice versa.

According to the invention, the locking device also comprises deadlocking means allowing to prevent the movement of the driving element at least when said driving element is in said second position. Thanks to the presence of said deadlocking means, the risk that said first and second engaging elements accidentally leave said second configuration in which they are engaged with each other is avoided. As a result, if during skiing the driving element is subjected to stress and/or impacts which could cause a movement of said driving element away from the second position sufficient to cause the disengagement of the first and second engaging elements of the locking device, such movement is effectively prevented by the deadlocking means.

Optionally, the locking device may include further deadlocking means to allow to prevent the movement of the driving element when said driving element is in the first position. However, it will be evident to those skilled in the art that the presence of said further deadlocking means is completely optional and not necessary for satisfactory use of the ski boot.

In fact, first of all, the ski boot is subject to lower stresses and weaker impacts during walking. Secondly, it is highly unlikely that the first and second engaging elements of the locking device will accidentally come into engagement with each other, whereby the elastic return force of the elastic element will be sufficient to bring the driving element back to the first position.

According to a preferred embodiment of the invention, the driving element is connected to one out of the shell and the cuff of the ski boot and the deadlocking means comprise a first deadlocking element integral with or connected to the driving element and a second deadlocking element integral with or connected to the other one of the shell and the cuff of the ski boot.

The deadlocking means further comprise a control element which acts onto the first and/or the second deadlocking element to control switching from a configuration in which said first and said second deadlocking elements cooperate with each other to prevent movements of the driving element of the locking device, to a configuration in which said first and said second deadlocking elements do not cooperate with each other and movements of the driving element of the locking device are allowed.

In a particularly preferred embodiment of the invention, one of the deadlocking elements is a movable deadlocking element having a cam profile, the other deadlocking element is made in the form of an abutment surface and the control element is configured to rotate said movable deadlocking element: said movable deadlocking element, when rotating, can switch, thanks to its irregular profile, from a configuration in which it is in engagement with the other deadlocking element to a configuration in which it is disengaged from it, and vice versa.

BRIEF DESCRIPTION OF THE DRAWINGS

Further features and advantages of the invention will become more evident from the following detailed description of a preferred embodiment, given by way of non-limiting example, with reference to the attached drawings, in which.

DETAILED DESCRIPTION

The preferred embodiment of the invention described below refers to the application of the invention to a boot for ski mountaineering. However, this embodiment shall in no way be understood as limiting the scope of the invention.

Figure 1:
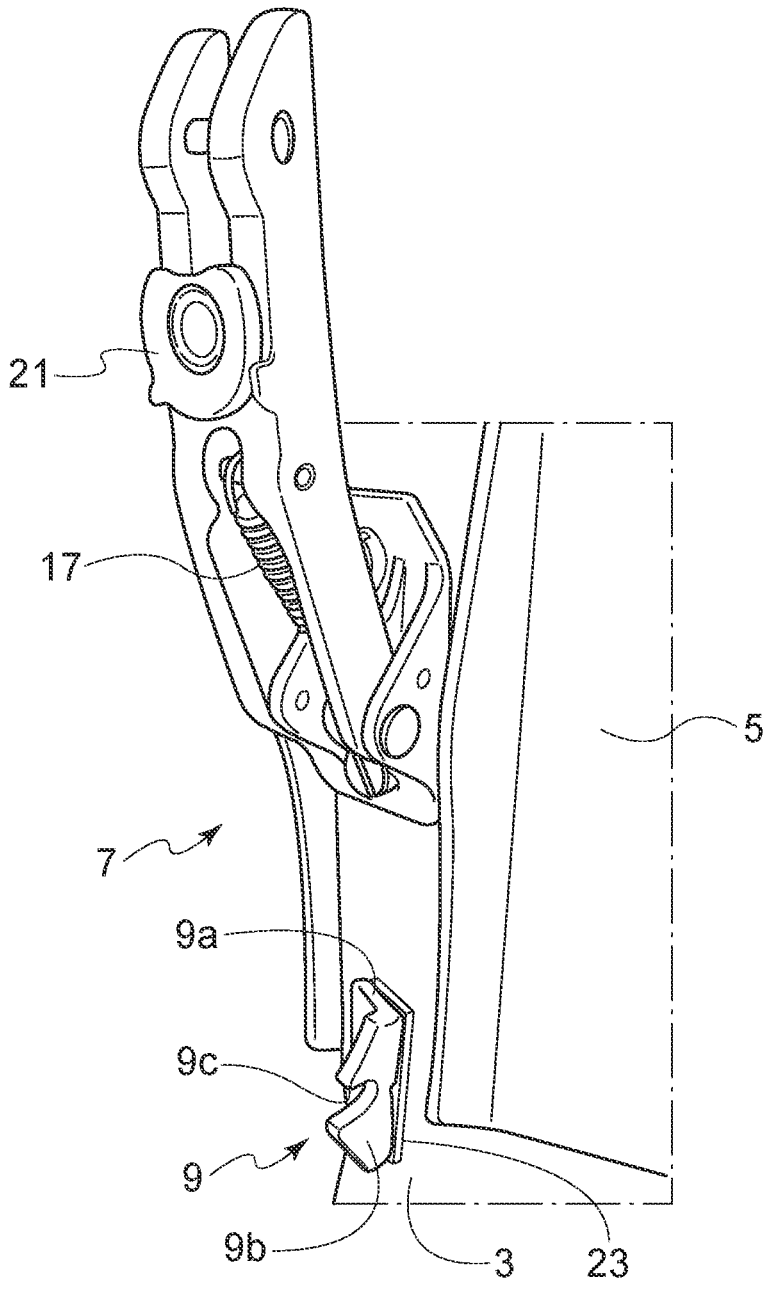
FIG. 1 illustrates the locking device of a ski boot according to a preferred embodiment of the invention, shown in a first configuration or walking configuration.
Figure 2:
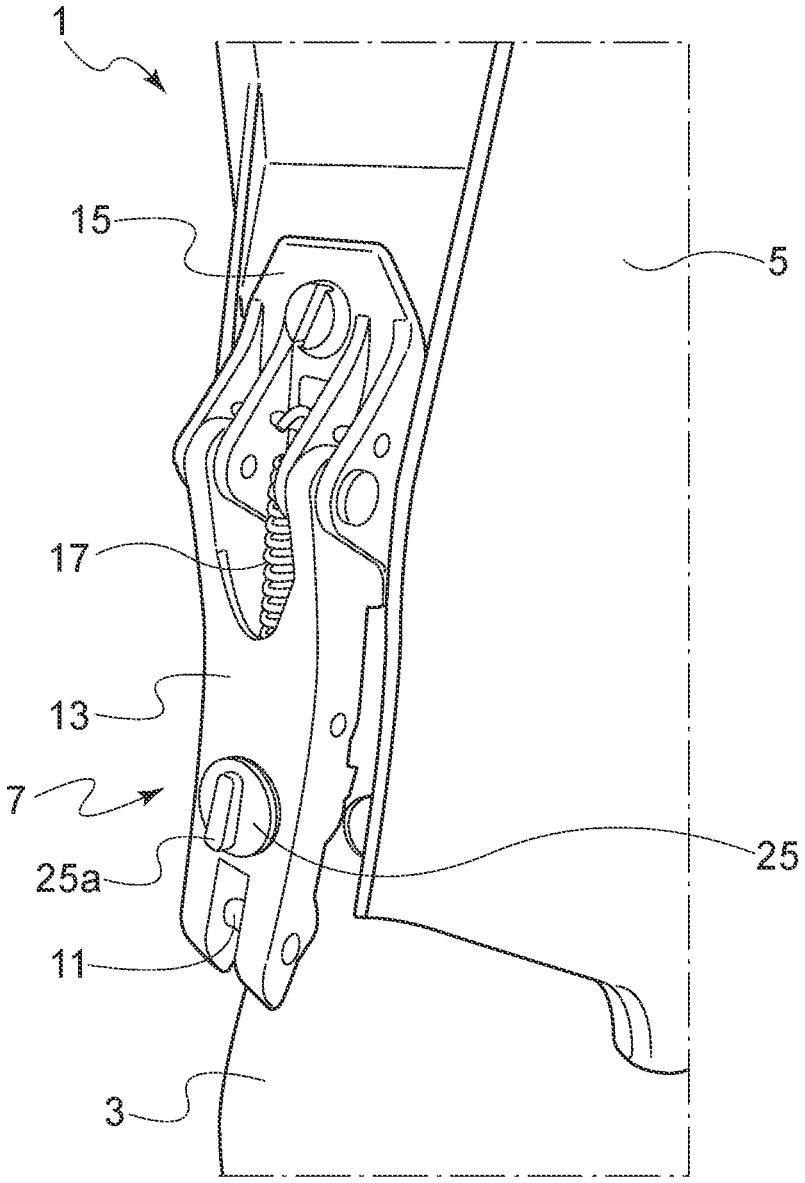
FIG. 2 illustrates the locking device of FIG. 1, shown in a second configuration or skiing configuration.

Such a ski boot 1 is partially shown in FIGS. 1 and 2.

In a per se known manner, the ski boot 1 comprises an inner element or inner liner made of a substantially soft material (not visible in the Figures) and an outer element or outer shell 3 made of a substantially rigid material.

The outer shell 3 is shaped to accommodate the user's foot and the ski boot 1 also comprises a cuff 5, which is also made of a substantially rigid material and is articulated to the outer shell 3 by means of rotation pins (not visible in the Figures) at the two opposite sides of said outer shell, substantially at the malleolar region.

The ski boot 1 further comprises a locking device 7 to selectively allow or prevent rotation of the cuff 5 relative to the shell 3.

FIGS. 1 and 2 show a detail of the ski boot 1 which refers to said locking device 7. The locking device 7 comprises a first engaging element 9 which is integral with or connected to the shell. In the shown embodiment, said first engaging element is a female engaging element, and comprises a plate 9*a* fixed to the shell 3 and carrying a cantilevered tab 9*b* in which a seat 9*c* is formed.

Correspondingly, the locking device comprises a second engaging element 11 which is integral with or connected to the cuff and which is configured to cooperate with the first engaging element 9. It is evident that in the shown embodiment the second engaging element 11 has to be designed as a male engaging element; in detail, it is designed as a bar 11 which can be received and retained in the seat 9*c* of the first engaging element 9. It is evident that it would also be possible to provide a first, male engaging element integral with or connected to the shell and a second, female engaging element integral with or connected to the cuff.

The locking device 7 comprises a driving element 13 which can switch from a first position, in which said first and said second engaging element 9, 11 are in a first configuration in which they are disengaged from each other, to a second position, in which said first and second engaging elements 9, 11 are in a second configuration in which they are engaged with each other, and vice versa.

More particularly, in the embodiment shown in the Figures, said driving element is a driving lever 13 which is rotatably connected to a base plate 15 fixed to the cuff 5 at a first end and carries the second engaging element 11, i.e., the bar 11, at its second opposite end.

In detail, the second end of the driving lever 13 has two parallel arms 13*b*, 13*c* separated from each other by a gap 13*a*, transversely to which the bar 11 is mounted.

It is evident that, in an alternative embodiment of the invention, the driving lever could be rotatably connected to the shell at a first end and carry the first engaging element to its second, opposite end.

It is also evident that, in further alternative embodiments, the driving element could also be made in a form other than a driving lever.

Referring back to the embodiment shown in the Figures, in the first position of the driving lever 13 (FIG. 1), the first and second engaging elements 9, 11 are disengaged from each other and the cuff 5 is free to rotate relative to the shell 3; in the second position of the driving lever 13 (FIG. 2), the first and second engaging elements 9, 11 are engaged with each other (i.e., the bar 11 is inserted in the seat 9*c* of the first engaging element 9) and rotation of the cuff 5 relative to the shell 3 is prevented.

For switching from the first to the second position, the driving lever 13 has to overcome the elastic resistance of a spring 17 which tends to keep said driving lever stably in said first position.

Once the driving lever has been switched to the second position, the engagement between said first and said second engaging element 9, 11 stably keeps said driving lever in said position: in order to switch the driving lever back to the first position it is necessary for the user to manually disengage the first and second engaging elements 9, 11, after which the spring 17, returning to its rest configuration, will bring said driving lever 13 back to the first position.

In order to avoid accidental disengagement between the first and second engaging elements 9, 11 as a result of stresses or impacts to which the ski boot is subjected during sports practice, the invention advantageously provides that the locking device 7 is provided with deadlocking means 19 which prevent the movement of the driving lever 13 when it is in the second position.

Figure 3A:
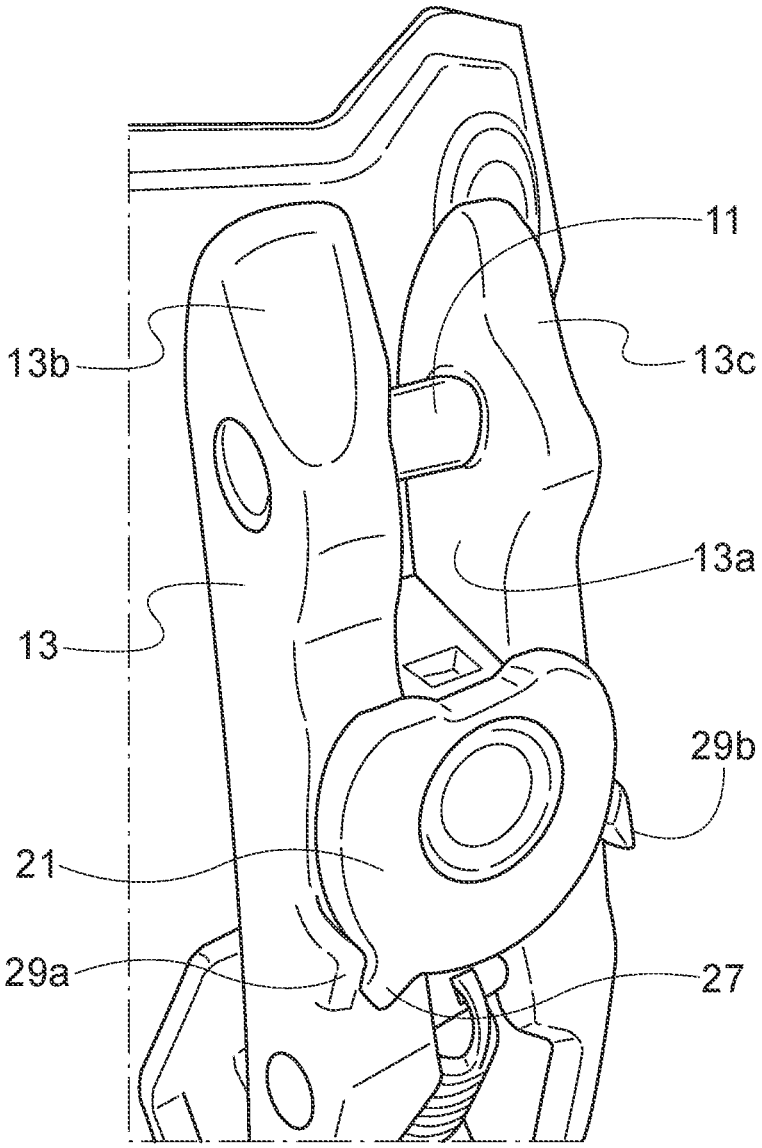
FIGS. 3*a*-3*c* show in detail the deadlocking means of the locking device of FIGS. 1-2.
Figure 3B:
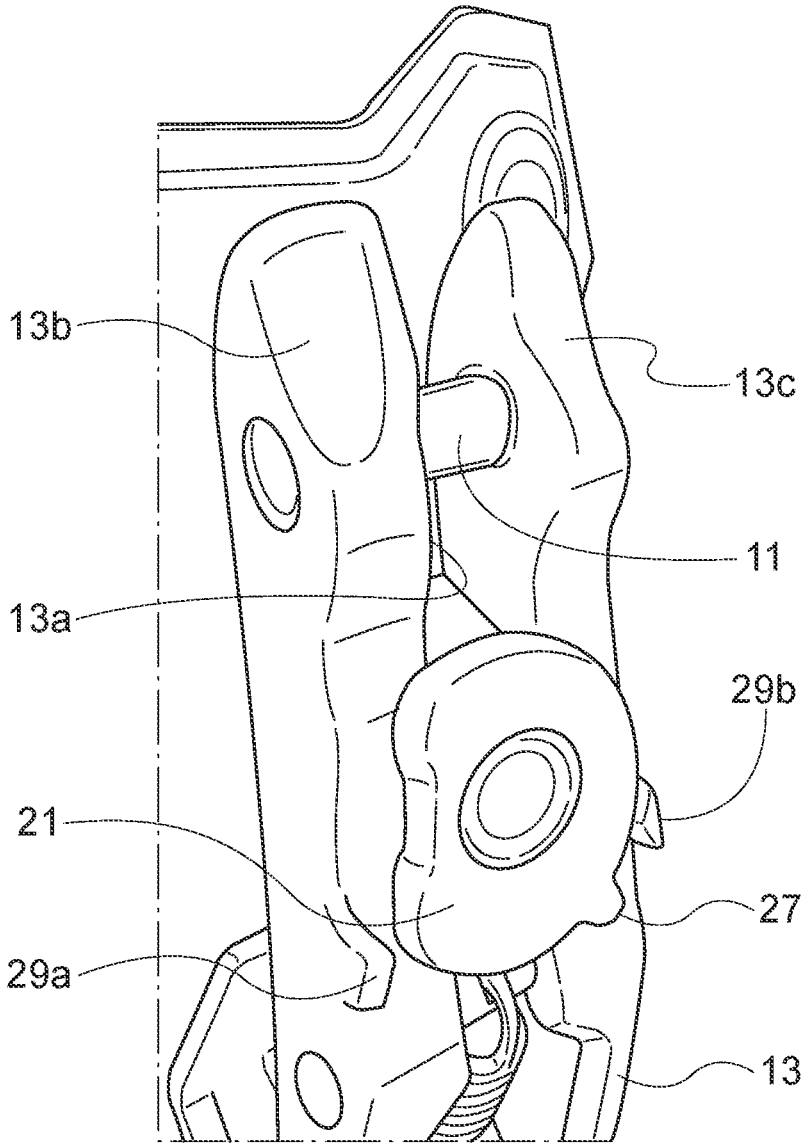
Figure 3C:
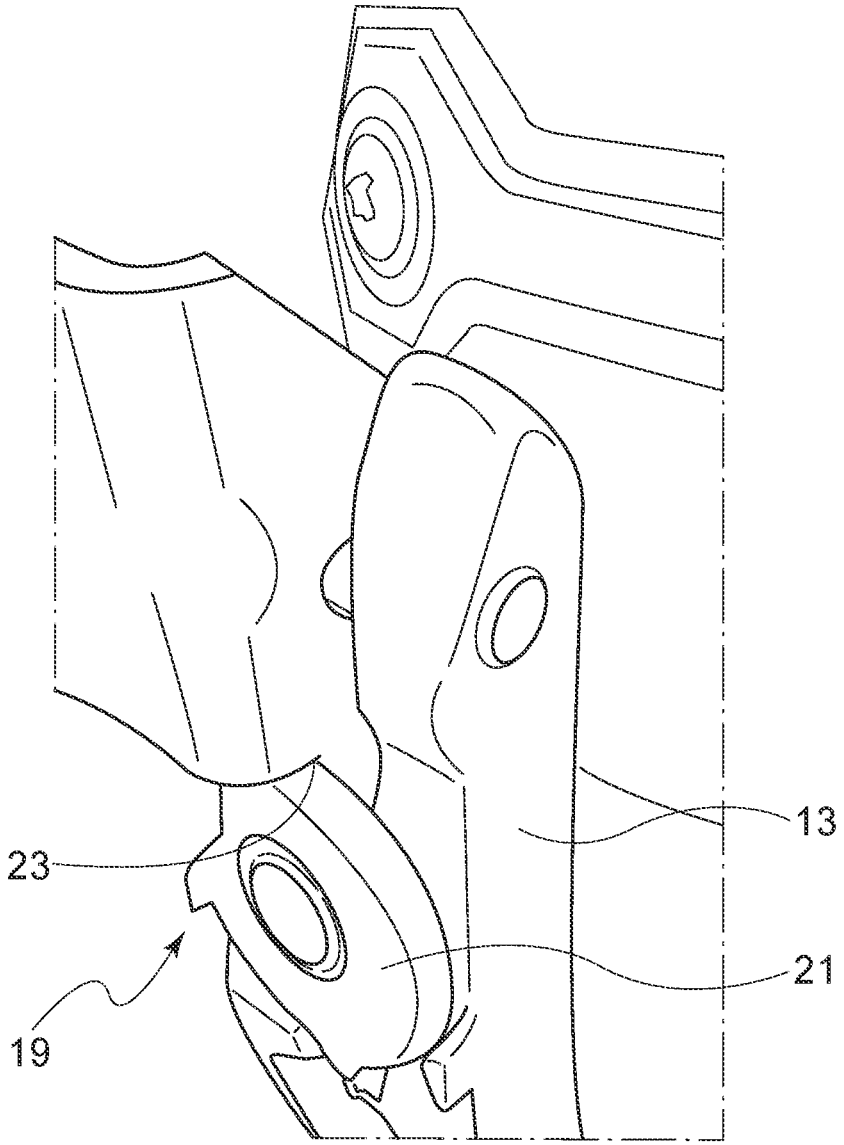

With reference to FIGS. 3*a*-3*c*, said deadlocking means 19 may comprise a first deadlocking element 21 integral with or connected to the driving lever 13, a second deadlocking element 23 integral with or connected to the shell 3 of the ski boot, and a control element 25 which acts onto said first and/or said second deadlocking element for switching said deadlocking means 19 between a configuration in which said first and said second deadlocking element 21, 23 cooperate with each other to prevent movement of the driving lever 13, and a configuration in which said first and second deadlocking elements 21, 23 do not cooperate with each other and movement of the driving lever 13 is allowed.

It will be evident to the person skilled in the art that in the embodiments in which the driving element is connected to the shell of the ski boot, the second deadlocking element will be integral with or connected to the cuff of said boot.

In the embodiment of the invention shown in the Figures, the first deadlocking element 21 is an element with an irregular profile (for example, a cam profile) which is rotatably mounted on the driving lever 13 and is controlled in rotation by the control element 25.

As can be seen in FIGS. 3*a*, 3*b*, the first deadlocking element 21 comprises a portion with a larger diameter and a portion with a smaller diameter.

It is to be noted that the maximum diameter of the first deadlocking element 21 is smaller than the width of the driving lever 13, so that, when the driving lever is in the second position and the first and second engaging elements 9, 11 are engaged with each other, the first deadlocking element is completely covered by the driving lever and is not subjected to stresses or impacts (see FIG. 2).

It is also to be noted that the control element 25 comprises gripping means 25*a* which—while allowing the user to act onto said control element—have a size as small as possible, so as to be also minimally subject to stresses or impacts.

The first deadlocking element 21 can be rotated by the control element 25 between two limit positions, determined by a stop element 27 provided on said first deadlocking element and by two corresponding stops 29*a*, 29*b* provided on opposite walls of the driving lever 13.

In a first limit position, shown in FIG. 3*a*, the smaller diameter portion of the first deadlocking element 21 faces the gap 13*a* of the driving lever 13 which receives the bar 11 and the first deadlocking element 21 does not obstruct in any way this gap. In other words, the outer surface of the first deadlocking element is substantially aligned with the end wall of the gap 13*a* of the operating lever 13 and the provision of said first deadlocking element is completely irrelevant.

In a second limit position, shown in FIG. 3*b*, it is the portion with the larger diameter of the first deadlocking element 21 that faces the gap 13*a* of the driving lever 13 which receives the bar 11, so that the first deadlocking element 21 obstructs to some extent the bottom portion of this gap. In other words, the outer surface of the first deadlocking element protrudes from the end wall of the gap 13*a* of the driving lever 13 and the provision of said first deadlocking element becomes relevant.

In FIG. 3*c*, the second deadlocking element 23 is illustrated separated from the shell 3 of the ski boot 1, in order to show the cooperation between the first and the second deadlocking elements 21, 23.

In the shown embodiment, the second deadlocking element is made as an abutment surface 23 which is arranged flush with the bottom portion of the gap 13*a* of the driving lever 13 when said driving lever is in the second position.

It is therefore evident that, if the first deadlocking element 21 is in the first limit position shown in FIG. 3*a*, the driving lever can be freely moved. Instead, if the first deadlocking element 21 is in the second limit position shown in FIG. 3*b*, any attempt to move the driving lever from its second position will bring the surface of the portion of the first deadlocking element protruding from the end wall of the gap 13*a* to abut against the abutment surface 23, thus preventing any movement that could lead to disengagement of the first and second engaging elements 21, 23.

Therefore, when the user intends to switch the ski boot to the configuration suitable for skiing:

- he/she moves the first deadlocking element 21 to its first limit position, in which it does not hinder the movement of the driving lever 13;
- with the first deadlocking element 21 in its first limit position, he/she moves the driving lever 13 to its second position, in which the first and second engaging elements are mutually engaged; and
- with the first and second engaging elements mutually engaged, he/she moves the first deadlocking element 21 to its second limit position, in which it cooperates with the second deadlocking element (abutment surface) 23 so as to prevent any further movement of the driving lever 13.

In order to switch the ski boot to the configuration suitable for walking, the user must first act onto the control element 25 of the deadlocking means 19 to move back the first deadlocking element to its first limit position.

As mentioned above, this control element 25 is shaped in such a way as to make accidental and unwanted movement of the first deadlocking element highly unlikely.

The second deadlocking element 23 could be a separate element secured to the shell 3 of the ski boot 1. However, in the shown embodiment (and as clearly visible in FIG. 3*c*), said second deadlocking element is made integral with the first engaging element 9 of the locking device.

In detail, the abutment surface 23 is obtained by suitably shaping the plate 9*a* of the first engaging element 9.

It will be evident to the person skilled in the art that the embodiment disclosed above in detail shall in no way be understood in a limiting sense and several variants and modifications are possible without thereby departing from the scope of the invention as defined by the appended claims.

The invention claimed is:

1. A ski boot, comprising an outer shell made of a substantially rigid material, a cuff articulated to the outer shell, and a locking device for selectively allowing or preventing movement of the cuff relative to the shell, wherein the locking device comprises:

- a first engaging element integral with or connected to the shell,
- a second engaging element integral with or connected to the cuff,
- a driving element, and
- a spring having an elastic resistance,
- wherein the driving element is switchable from a first position, in which the spring is in a resting condition, the first and the second engaging elements are in a first configuration in which they are disengaged from each other, and the movement of the cuff relative to the shell is allowed, to a second position, in which the elastic resistance of the spring has been overcome, the first and the second engaging elements are in a second configuration in which they are engaged with each other, and the movement of the cuff relative to the shell is prevented, and vice versa, wherein the locking device further comprises deadlocking means which prevents movement of the driving element when the driving element is in the second position, wherein the driving element is connected to the cuff of the ski boot, wherein the deadlocking means comprises a first deadlocking element integral with or connected to the driving element and a second deadlocking element integral with or connected to the shell of the ski boot, wherein at least one of the first and second deadlocking elements is movable, and wherein the deadlocking means further comprises a control element for controlling movement of the at least one of the first and second deadlocking elements between a first position, in which the control element does not cooperate with the other one of the first and second deadlocking elements and the movement of the driving element to the second position is allowed, and a second position, in which the control element cooperates with the other one of the first and second deadlocking elements and the movement of the driving element out from the second position is prevented, whereby the deadlocking means is configured to prevent the movement of the driving element out of the second position even if a force larger than the elastic resistance of the spring is applied to the driving element, wherein the first deadlocking element has an irregular profile with a first portion having a first diameter and a second portion having a second diameter, the first diameter of the first portion being larger than the second diameter of the second portion, wherein the first deadlocking element is rotatably mounted on the driving element and is controlled in rotation by the control element, wherein the second deadlocking element is an abutment surface for the first deadlocking element, the first deadlocking element being arranged so as to abut against the second deadlocking element when the first portion of the first diameter is aligned with the abutment surface and not to abut against the second deadlocking element when the second portion of the second diameter is aligned with the abutment surface, and wherein the control element is arranged to rotate the first deadlocking element between a first limit position in which the second portion of the second diameter is aligned with the abutment surface and a second limit position in which the first portion of the first diameter portion is aligned with the abutment surface.

2. The ski boot according to claim 1, wherein the locking device further comprises additional deadlocking means which prevents the movement of the driving element when the driving element is in the first position.

3. The ski boot according to claim 1, wherein the first deadlocking element and the driving element are arranged and sized so that the first deadlocking element is inaccessible when the driving element is in the second position.

4. The ski boot according to claim 1, wherein the second deadlocking element is integral with the first engaging element.

5. A ski boot, comprising an outer shell made of a substantially rigid material, a cuff articulated to the outer shell, and a locking device for selectively allowing or preventing movement of the cuff relative to the shell, wherein the locking device comprises:

a first engaging element integral with or connected to the shell;

a second engaging element integral with or connected to the cuff;

a driving element; and a spring having an elastic resistance;

wherein the driving element is switchable from a first position, in which the spring is in resting condition, the first and the second engaging elements are in a first configuration in which they are disengaged from each other, and the movement of the cuff relative to the shell is allowed, to a second position, in which the elastic resistance of the spring has been overcome, the first and the second engaging elements are in a second configuration in which they are engaged with each other, and the movement of the cuff relative to the shell is prevented, and vice versa;

wherein the locking device further comprises deadlocking means which prevents movement of the driving element when the driving element is in the second position;

wherein the driving element is connected to the shell of the ski boot;

wherein the deadlocking means comprises a first deadlocking element integral with or connected to the driving element and a second deadlocking element integral with or connected to the cuff of the ski boot;

wherein at least one of the first and second deadlocking elements is movable;

wherein the deadlocking means further comprise a control element for controlling movement of the at least one of the first and second deadlocking elements between a first position, in which the control element does not cooperate with the other one of the first and second deadlocking elements and the movement of the driving element out from the second position is allowed, and a second position, in which the control element cooperates with the other one of the first and second deadlocking elements and the movement of the driving element out from the second position is prevented, whereby the deadlocking means is configured to prevent the movement of the driving element out of the second position even if a force larger than the elastic resistance of the spring is applied to the driving element, wherein the first deadlocking element has an irregular profile with a first portion having a first diameter and a second portion having a second diameter, the first diameter of the first portion being larger than the second diameter of the second portion;

wherein the first deadlocking element is rotatably mounted on the driving element and is controlled in rotation by the control element;

wherein the second deadlocking element is an abutment surface for the first deadlocking element, the first deadlocking element being arranged so as to abut against the second deadlocking element when the first portion having the first diameter is aligned with the abutment surface and not to abut against the second deadlocking element when the second portion having the second diameter is aligned with the abutment surface, and wherein the control element is arranged to rotate the first deadlocking element between a first limit position in which the second portion having the second diameter is aligned with the abutment surface and a second limit position in which the first portion having the first diameter is aligned with the abutment surface.

6. The ski boot according to claim 5, wherein the locking device further comprises additional deadlocking means which prevents the movement of the driving element when the driving element is in the first position.

7. The ski boot according to claim 5, wherein the first deadlocking element and the driving element are arranged and sized so that the first deadlocking element is inaccessible when the driving element is in the second position.

8. The ski boot according to claim 5, wherein the second deadlocking element is integral with the second engaging element.

* * * * *